United States Patent [19]

Cromer

[11] Patent Number: 4,719,761

[45] Date of Patent: Jan. 19, 1988

[54] COOLING SYSTEM

[76] Inventor: Charles J. Cromer, 460 Indian Creek Dr., Cocoa Beach, Fla. 32931

[21] Appl. No.: 868,581

[22] Filed: May 30, 1986

[51] Int. Cl.[4] ..... F25D 17/06

[52] U.S. Cl. ..... 62/94; 62/271

[58] Field of Search ..... 62/93, 94, 95, 271, 62/315, 91, 92

[56] References Cited

U.S. PATENT DOCUMENTS

| | | | |
|---|---|---|---|
| 2,672,024 | 3/1954 | McGrath | 62/94 |
| 2,952,993 | 9/1960 | Bosworth, Jr. | 62/271 |
| 4,259,849 | 4/1981 | Griffiths | 62/271 |
| 4,467,785 | 8/1984 | Langford et al. | 62/271 X |

*Primary Examiner*—Lloyd L. King

*Attorney, Agent, or Firm*—William M. Hobby

[57] ABSTRACT

Method and apparatus for increasing removal of moisture in a cooling system provides for a desiccant to contact and evaporate moisture into the dry feed air prior to passing the feed air over cooling coils to increase the dew point (moisture content) of the feed air. This increases the moisture removal of the cooling system. The desiccant material is loaded with moisture by absorption of moisture from the moisture saturated air leaving the cooling coils. The method includes removing the moisture by desiccant from the saturated air leaving a cooling means and delivers it to dry air entering said cooling means thus, increasing the dehumidification of the cooling means.

2 Claims, 5 Drawing Figures

COOLING SYSTEM

BACKGROUND OF THE INVENTION

The present invention relates to a method and apparatus of removing moisture from air passing through an air cooling system.

The population in the U.S. is shifting toward the Southern part of the country. National Association of Home Builders figures indicates that out of 1.7 million housing starts in 1983, approximately 67.8% occurred in the South. Of the housing starts in the South, it is estimated that about 62% occurred in the Southeastern U.S., which generally experiences long, hot, humid summers. As more and more homes are built in the South, cooling energy use increases. For example, the average Florida home uses 30% of needed energy for cooling.

Alternatives have been introduced throughout the United States to reduce the use of cooling energy. Thermostats have been raised in summer and considerable work has been completed in the area of passive cooling to provide reduced energy loads and maintain comfortable conditions; radiant barriers, ceiling fans, vent-skin walls, vent-skin roofs and enhanced ventilation techniques are among these. These techniques cannot, however, remove the moisture load on the building environment. Under typical construction techniques and infiltration, the moisture in the humid Southeastern USA may comprise 30%–40% of the overall AC load. However, as conserving building techniques are incorporated to reduce the sensible heat load, the moisture or latent load may reach over 60% of the cooling energy required to maintain comfort conditions.

Dehumidifiers that are presently commercially available are relatively inefficient. The cooling energy of a particular evaporator coil design is part sensible (heat removal), and part latent (moisture removal). The ratio of sensible heat removed to the total cooling energy is called the sensible heat ratio (SHR) and is fixed by the AC design for any operation inputs. A typical AC unit cannot dehumidify more than its coil design ratio. So to remove more moisture by traditional air conditioning, one has to lower the thermostat causing excessive cooling. This is not only counter productive to the passive cooling techniques that may be employed, but also may result in uncomfortable, cold-clammy environments and cause excessive energy use.

The improvement of the energy efficiency (SEER) of air conditioner equipment by manufacturers has been undertaken to reduce energy consumption. This has been accomplished by enlarging the heat exchange coils utilized by the improved AC equipment. When such equipment is installed properly i.e., installations are down sized from normal sizing such that short-cycling does not occur, energy efficiency is improved. The larger coils, however, have the negative side effect of increasing the sensible to latent operating ratio of the equipment. They thus remove less moisture and exacerbate the dehumidification problem.

To remove moisture from air, it must first be cooled to its dew point. A typical dehumidifier utilizes the condenser heat available in its condenser coil to reheat the air that has been cooled to its dew point temperature for dehumidification purposes. This reheat delivers the air at the desired temperature to the space. While this process is workable, it does not increase the efficiency of the apparatus. In some systems, primarily commercial, the reheat is provided via electrically driven resistance coils. This approach is workable but is energy inefficient.

It is also well known that heat exchangers can be utilized in connection with ventilating and air-conditioning devices. These devices usually include a means for bringing in fresh outside air and transferring heat from the incoming outside air to the exhausted inside air, thus reducing the heat load of the fresh air and providing reheat. This process, however, brings in moisture associated with the outside air.

Recent advances in the application of heat exchangers to AC equipment for dehumidification purposes have been made by Earl Doderer of Trinity University of San Antonio, Tex., and Mukesh Khattar of the Florida Solar Energy Center in Cape Canaveral, Fla.

The Doderer system as set forth in U.S. Pat. No. 4,428,205, utilizes a cross flow heat exchanger to provide heat transfer from the hotter room air being drawn toward the AC cooling coil. The heat passes to the chilled air leaving the coil going to the room. Thus, reheat is provided from air entering the equipment at no additional energy expense. Thus, an energy efficiency is achieved in the dehumidification process. To obtain the proper heat transfer very large heat exchange surfaces are necessary.

Mukesh Khattar has analyzed the application of heat pipe technology to this heat transfer application. This application was originally proposed by Kahn Dinh of Gainsville, Fla. Rather than large cross flow plenem-type exchangers, heat pipe coils similar to those commonly in use by the HVAC industry are employed. Though both these methods improve dehumidification efficiency, some efficiency gain is lost due to the increased fan power requirements. The energy gain is also limited to sensible heat transfer which provides for colder cooling coil operating temperatures reducing the operational COP of the equipment.

The application of desiccants to utilize heat transfer through heat of sorption and desorption as well as direct moisture transfer show promise for major dehumidification efficiency improvements over standard AC equipment with a minimal increase in fan power and improved COP.

Prior art may be seen in the Newton U.S. Pat. No. 2,811,223 which shows a pair of heat exchangers with a dryer in front of each and a water sprayer tacked onto the second heat exchanger. The Northrup, Jr. U.S. Pat. No. 4,180,985 shows a desiccant dryer used in connection with a pair of cooling coils for removing moisture from the system. The Griffiths U.S. Pat. No. 4,164,125 shows a solar energy assisted air conditioning system which disperses a shower of moisture into the cooling coil and then collects the condensed moisture for later use. The Turner U.S. Pat. No. 4,171,620 provides for dehumidification by contact of the air with a hygroscopic solution. A pair of Rush U.S. Pat. Nos. 4,180,126 and 4,081,024 each show air conditioning systems using drying wheels.

SUMMARY OF THE INVENTION

A moisture removal system and method is provided for increasing the removal of moisture in a cooling system. The moisture removal system includes an air conditioner system having a heat exchanger having an inlet thereinto and an exit therefrom. A moisture evaporator adds moisture to the inlet of the air conditioning system to increase the dew point for increased removal by the air conditioning heat exchanger cooling coils. A moisture removal desiccant captures moisture passing through the heat exchanger exit and feeds the removed moisture from the moisture removal desiccant to the moisture evaporator for adding the moisture back to the air inlet of the air conditioning system so that the dew point of the air entering the heat exchanger cooling coils is substantially increased prior to reaching the heat exchanger.

A moisture removal method includes the steps of evaporating moisture into the dry feed air of the cooling coils in an air conditioning system and passing the moisture laden air through the cooling coils of the air conditioning system for increased removal of the moisture from the air passing therethrough. Removing moisture from the air passing through the cooling coils and evaporating the moisture removed from the air passing through the cooling coils back into the dry feed air of the cooling coils of the air conditioning system so that increased moisture removal is obtained by the air conditioning system.

BRIEF DESCRIPTION OF THE DRAWINGS

Other objects, features and advantages of the present invention will be apparent from the written description and the drawings in which.

DESCRIPTION OF THE PREFERRED EMBODIMENTS

The method and apparatus for the dehumidification enhancement of cooling means has as its essential components a moisture transfer means, and a cooling means. The cooling means must be capable to reduce the temperature of the air coming from a conditioned environment to below its dew point, thus, causing condensation and the removal of moisture from the air. Such cooling may be provided by a vapor compression cycle-device as in a conventional electrically driven air conditioner or refrigerator, or it may be provided by a chilled fluid or brine or a solid or any other cooling means.

The apparatus and method of this invention differs from a conventional air conditioner in that the dew point (moisture content) of the incoming air is substantially increased by the transfer of moisture to it before it reaches the cooling coil. An increased average coil temperature results in the improved energy efficiency over prior methods of sensible heat transfer for dehumidification enhancement and an increased dehumidification over a conventional air conditioner.

Figure 5:
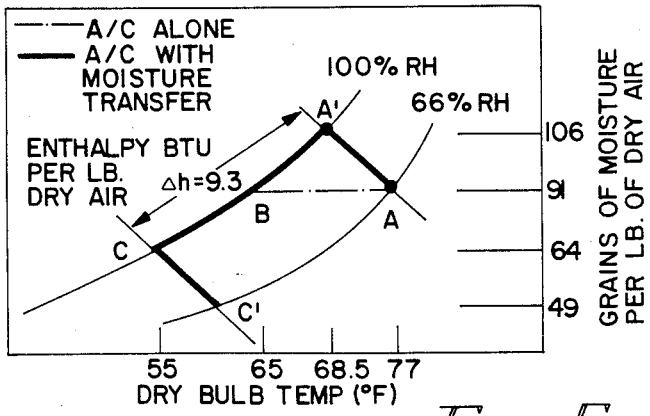
FIG. 5 is a comparative psycho-metric chart.

In FIG. 5 of the drawings, a psychometric chart of the type commonly used to describe thermodynamic processes acting upon air has a horizontal axis with the temperature of the air in degrees Fahrenheit, and a vertical axis with the moisture content of the air in grains of moisture per lb. of dry air. The curved lines sloping downward from right to left are lines of constant relative humidity of the air with the left most line depicting air which is at 100% relative humidity or saturation, i.e., the air's dew point at which water begins to condense. The straight lines sloping downward from left to right depict lines of constant heat (both sensible and latent) or constant enthalpy.

An analysis of experimental data on a conventional air conditioner provides a comparison between its operation and the operational theory of the air conditioner with the invention attached.

The temperature and humidity of a typical packet (one pound) of air is traced on a psychometric chart as air moves through the respective systems. The inlet conditions (room conditions) are shown as point A, and are 77 degrees Fahrenheit with 91 grains of water.

The conventional air conditioner as shown has the air entering the cooling coil section at Point A. As the air flows along the first cold coils it is first cooled along line AB at constant moisture content until the temperature reaches the dew point (Point B) of approximately 65 degrees Fahrenheit. At this point, the enthalpy exchange is 2.8 Btu's. Then, the air moves along the curved path BC during which condensation occurs and the dew point is reduced as moisture is condensed from the air. Point C is the state of the air as it leaves the air conditioner and reenters the room at 55 degrees Fahrenheit with 64 grains of moisture. The total moisture removed was $91-64=27$ grains of water and the heat or enthalpy pumped out of the room by the air conditioner was 9.3 Btu's. The average coil temperature on AB is:

$$(77-65)/2+65=70^\circ \text{ F.},$$

on BC is:

$$(65-55)/2+55=50^\circ \text{ F.}$$

Total process AC coil temperature weighted by enthalpy exchange is:

$$(6.5/9.3)\times 50^\circ+(2.8/9.3)\times 70^\circ=56.03^\circ \text{ F.}$$

average coil temperature.

In the present invention, the air enters (Point A) which has a desiccant moisture exchanger on the evaporation side. Moisture is added to the air by the desorbing desiccant along the line of constant enthalpy AA'. The air enters the cooling coil at Point A' containing 106 grains of moisture. The air then moves along line A'C to Point C exchanging the same amount of heat as previously, 9.3 Btu's. The air then leaves the coils and enters the desiccant moisture exchange section on the absorption side where water is absorbed by the desiccant from the saturated air. The air leaves the desiccant with 49 grains of moisture. The total moisture removed from the air is $91-49=42$ grains of water and the enthalpy exchange of the air conditioner coil was 9.3 Btu's, the same as before. The air conditioner process, A'C average coil temperature (enthalpy weighted) is $[(68.5-55)/2]+55=61.75^\circ$ F.

The present invention, added to this air conditioner system, however, removes more moisture, $42-27=15$ additional grains of water removed with the same heat removal 9.3 Btu's. Because the EER (energy efficiency ratio) or COP (coefficient of performance) of a vapor compression device improves with increased operational coil temperatures, the dehumidification is increased and also increases the COP of the vapor compression device utilizing less energy to move the 9.3 Btu's.

Figure 1:
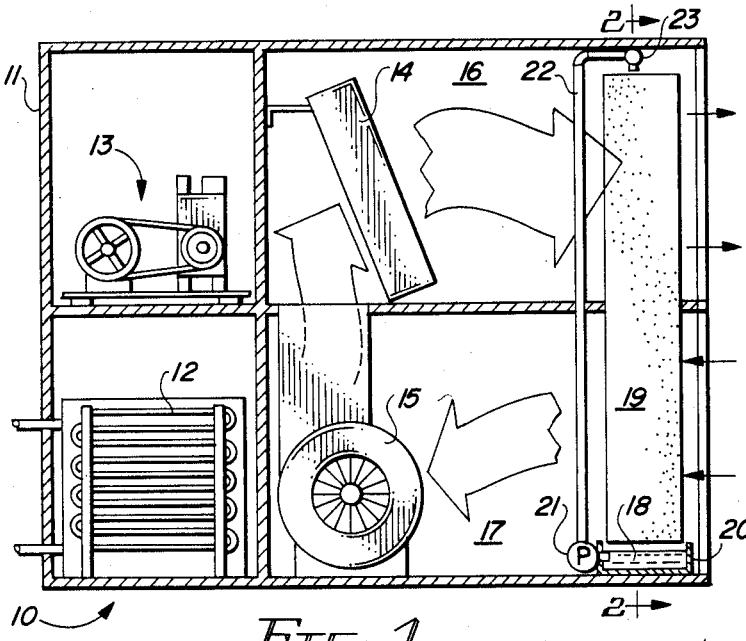
FIG. 1 is a side sectional view of a moisture removal system in accordance with the present invention.
Figure 2:
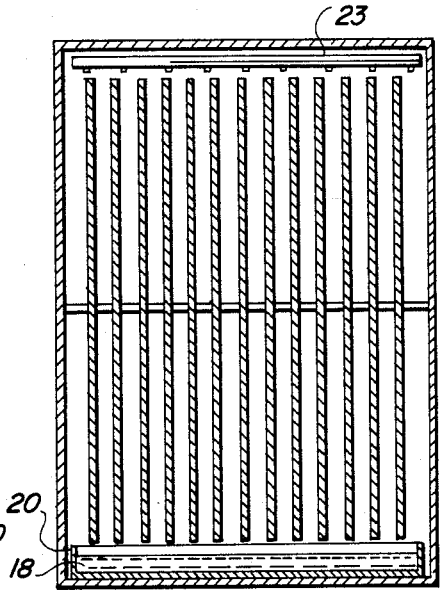
FIG. 2 is a sectional view taken on line 2—2 of FIG. 1.

Referring to FIGS. 1 and 2, an air conditioning and moisture removal system 10 in accordance with the present invention is illustrated placed in a housing 11 and having the standard air conditioning components of a condenser 12 which may be a water source or an air to air type condenser. The system also has a compressor 13 which compresses a refrigerant used in the system. The refrigerant is liquified in the condenser 12 and has the heat removed through a heat exchanger forming a part of the condenser and then expands into a cooling coil 14. The cooling coil acts as a heat exchanger and is positioned for air to pass through as shown by the arrows through a blower or fan 15 through the cooling coil 14 and out an exit passage 16. An inlet passage 17 brings in the dry feed air drawn by the blower 15 passes through the cooling coil and heat exchanger 14 and out the exit 16. In the present system, a plurality of vertically extending evaporator pads 19 extend across the inlet passageway 17 and the exit passageway 16. A liquid desiccant 18 collects in a trough 20 where a pump 21 pumps the liquid through a line 22 through nozzles 23 where it is sprayed upon the pads 19. The liquid desiccant allows the pads 19 to capture additional moisture leaving the exit passageway 16 to let the moisture drain down the pads 19 across the inlet passage 17 where the dry feed air is entering the system and where the moisture is then evaporated back into the dry feed air and partially removed by the cooling coils 14 and further removed by the liquid desiccant passing down to pads 19 in the exit air.

Figure 3:
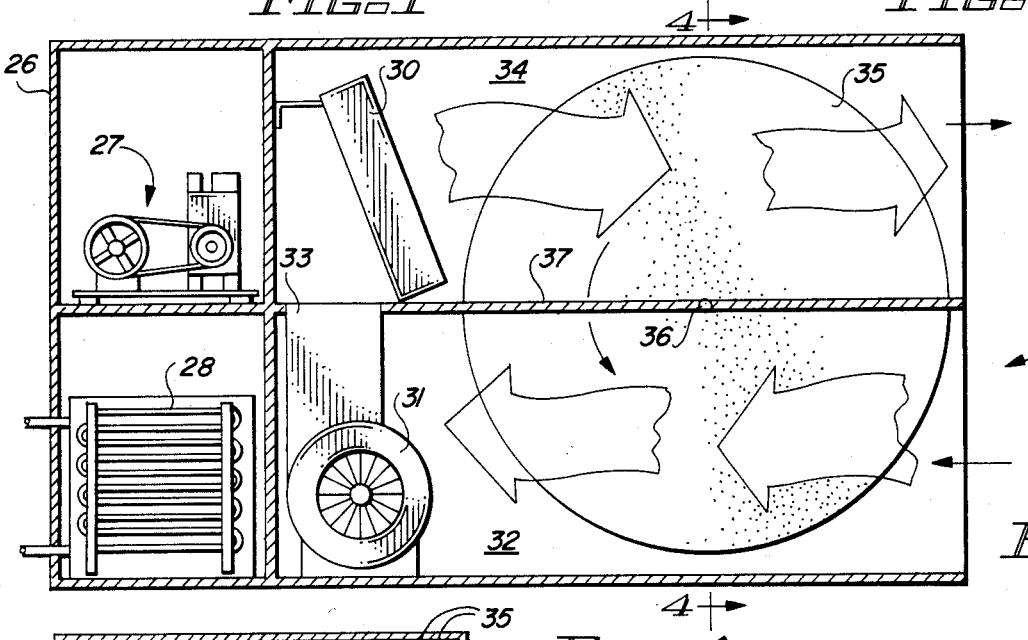
FIG. 3 is a side sectional view of an alternate embodiment of a moisture removal system.
Figure 4:
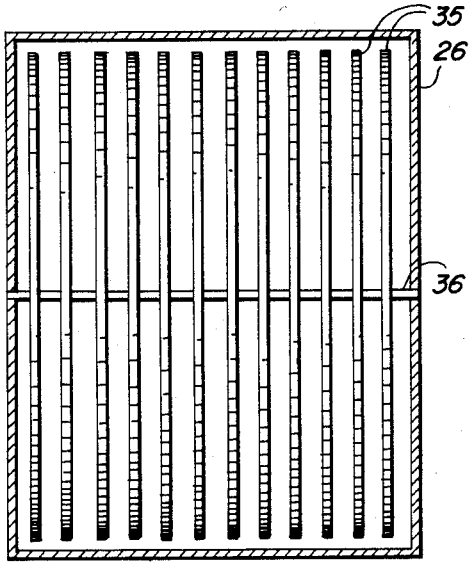
FIG. 4 is a sectional view taken on line 4—4 of FIG. 3.

In FIGS. 3 and 4 a similar air conditioning system and moisture removal system 25 has a housing 26 and has an air conditioning compressor 27 which is connected to a condenser 28 and to a cooling coil heat exchanger 30 in accordance with conventional air conditioning systems. A blower 31 is mounted in the intake air plenum for drawing the dry feed air through the inlet plenum 32 through a passageway 33 through the cooling coil and heat exchanger 30 and out the exit passageway 34. In this embodiment, a plurality of solid desiccant plates 35 are circular in shape and placed in a vertical position riding on a rotating shaft 36. Thus moisture laden air passing through the cooling coil 30 and out the exit passageway 34 is captured by the solid desiccant plates 35 which are rotated as they are capturing moisture until they pass through the dividing wall 37 into the inlet passageway 32 where the dry air entering the inlet passage 32 evaporates the moisture from the plates back into the air in a continuing rotation.

As can be seen from the moisture removal system, the method of removing moisture includes evaporating the moisture into the dry feed air entering through the inlet passageway 17 of FIG. 1 or 32 of FIG. 3, passing the moisture laden air through cooling coils 14 of FIG. 1 and 30 of FIG. 3 of the air conditioning system for increased removal of the moisture from the air passing therethrough. The next step is removing the moisture from the air passing through the cooling coils with a liquid desiccant in FIGS. 1 and 2 and with solid desiccant plates or membranes in FIGS. 3 and 4. And finally, evaporating the moisture removed from the air passing through the cooling coils and out the exit passageways 16 of FIG. 1 and 34 of FIG. 3, back into the dry feed air entering the inlet passageway 17 of FIG. 1 and 32 of FIG. 3, so that the moisture removed from the outlet of the air conditioning system is evaporated back into the dry feed air being fed to the cooling coils on a continuous basis to increase the dehumidification of the air.

It should be clear that a system for increasing the moisture removal from an air conditioning system has been provided but it should also be clear that the present invention is to be considered illustrative rather than restrictive.

I claim:

1. A moisture removal method comprising the steps of:

evaporating moisture into the dry feed air of the cooling coils of an air conditioning system;

passing the moisture laden air through the cooling coils of the air conditioning system for increased removal of the moisture from the air passing therethrough;

removing moisture from the air exiting the cooling coils; and evaporating moisture removed from the air exiting the cooling coils back into the dry feed air of the cooling coils of the air conditioning system, whereby increased moisture removal is obtained by the air conditioning system.

2. A moisture removal system comprising:

an air conditioner system having a heat exchanger to remove heat from air having an inlet thereinto and an exit therefrom;

moisture evaporative means for adding moisture to the inlet air of the heat exchanger;

moisture removal means for capturing moisture from air once exiting from the heat exchanger; and means to feed moisture removed by the moisture removal means to the moisture evaporative means for adding moisture back to the inlet air of the heat exchanger, whereby the dew point of the air entering the heat exchanger is substantially increased prior to reaching the heat exchanger, whereby the condensate moisture within the heat exchanger is substantially increased.

* * * * *